US010155601B2

(12) United States Patent
Nevot Banus

(10) Patent No.: US 10,155,601 B2
(45) Date of Patent: Dec. 18, 2018

(54) METHOD FOR FORMING A TUBULAR CONTAINER FOR FOOD PRODUCTS, AND RESULTING TUBE

(76) Inventor: Jordi Nevot Banus, Castellar del Valles (ES)

( * ) Notice: Subject to any disclaimer, the term of this patent is extended or adjusted under 35 U.S.C. 154(b) by 847 days.

(21) Appl. No.: 14/130,696

(22) PCT Filed: Jul. 6, 2012

(86) PCT No.: PCT/ES2012/070505

§ 371 (c)(1),
(2), (4) Date: Apr. 3, 2014

(87) PCT Pub. No.: WO2013/004880

PCT Pub. Date: Jan. 10, 2013

(65) Prior Publication Data

US 2014/0203022 A1 Jul. 24, 2014

(30) Foreign Application Priority Data

Jul. 6, 2011 (ES) ..... 201131146

(51) Int. Cl.
*B65B 11/58* (2006.01)
*B65B 43/10* (2006.01)
(Continued)

(52) U.S. Cl.
CPC ..... *B65B 43/10* (2013.01); *B65D 27/08* (2013.01); *B65D 75/38* (2013.01); *B65D 77/04* (2013.01)

(58) Field of Classification Search
CPC ..... B65D 75/38; B65D 85/8085
(Continued)

(56) References Cited

U.S. PATENT DOCUMENTS 2,154,521 A * 4/1939 Maxfield ..... B65B 9/213 206/484.2
3,674,134 A * 7/1972 Turner ..... B65D 75/5855 206/219
(Continued)

FOREIGN PATENT DOCUMENTS

DE 24 53 503 A1 5/1975
EP 1 988 021 A 11/2008
(Continued)

OTHER PUBLICATIONS

Apr. 27, 2016 Russian Office Action issued in connection with Russian Patent Application No. 20141033535/12(005489) (Jordi Nevot Banus) including English language translation.
(Continued)

*Primary Examiner* — Andrew M Tecco
*Assistant Examiner* — Eyamindae Jallow
(74) *Attorney, Agent, or Firm* — Gary J. Gershik; Cooper & Dunham LLP

(57) ABSTRACT

A method for forming a tubular container for food products and resulting container. The method comprising: folding or rolling a portion of the flexible sheet (3) forming a first tubular body (1); sealing one of the bases (1*a*) of the first tubular body (1); folding or rolling the rest of the flexible sheet (3) which is not part of said first tubular body (1) concentrically around the first tubular body (1), forming a second tubular body (2) outside the first tubular body (1); and joining part of the final longitudinal end of the inner surface of the second tubular body (2) to part of the outer surface of the first tubular body (1), forming two independent cavities: a first cavity (4) inside the first tubular body (1); and a second cavity (5) inside the second tubular body (2) and outside the first tubular body (1).

9 Claims, 4 Drawing Sheets

(51) Int. Cl.
*B65D 75/38* (2006.01)
*B65D 27/08* (2006.01)
*B65D 77/04* (2006.01)

(58) Field of Classification Search
USPC ..... 53/170, 171, 286, 449, 558
See application file for complete search history.

(56) References Cited

U.S. PATENT DOCUMENTS 3,763,622 A * 10/1973 Stanley, Jr. ..... B65D 81/3272 29/890.03
3,918,235 A 11/1975 Brown, Jr.
3,948,704 A 4/1976 Evans
3,980,222 A 9/1976 Hood
4,006,275 A 2/1977 Monia
4,282,812 A * 8/1981 Forgey ..... F42B 3/26 102/318
5,403,096 A * 4/1995 Aagesen ..... B65D 75/38 206/524.7
5,937,617 A * 8/1999 Yeager ..... B31B 19/84 206/217
6,082,585 A 7/2000 Mader et al.
6,298,984 B1 * 10/2001 Weaver ..... B01F 11/0065 206/219
7,674,041 B2 * 3/2010 Frayne ..... B65D 33/01 206/524.8
7,726,098 B2 * 6/2010 Doll ..... B65B 9/2028 53/133.8
2005/0105831 A1 * 5/2005 Weber ..... B65B 3/045 383/40
2005/0126936 A1 6/2005 Imaizumi
2011/0248045 A1 * 10/2011 Harris ..... B65B 29/10 222/94
2014/0248403 A1 * 9/2014 Spiegel ..... B65D 81/3261 426/120
2017/0043934 A1 * 2/2017 van den Berg ..... B65D 77/08

FOREIGN PATENT DOCUMENTS

JP 59115262 A 4/1984
JP 2004001838 A 1/2004
WO WO 2004/092031 A1 10/2004
WO WO 2006/127186 11/2006
WO WO 2008/112112 A1 9/2008

OTHER PUBLICATIONS

PCT International Search Report dated Oct. 29, 2012, in connection with PCT International Application No. PCT/ES2012/070505.
European Search Report issued by the European Patent Office dated Nov. 11, 2014 in connection with European Application No. ES 12808007.
Apr. 28, 2015 Chilean Written Opinion issued in connection with Chilean Patent Application No. 13-2014/00100 including English language translation.
May 21, 2015 Chinese Search Report issued by the Chinese Patent Office in connection with Chinese Patent Application No. IP1453979P including English language translation.
Oct. 21, 2014 Singapurean Search Report, issued in conncection with Singapurean Application No. 2014000665.

* cited by examiner

METHOD FOR FORMING A TUBULAR CONTAINER FOR FOOD PRODUCTS, AND RESULTING TUBE

RELATED APPLICATIONS

This application is a § 371 national stage of PCT International Application No. PCT/ES2012/070505, filed Jul. 6, 2012, claiming priority of Spanish Patent Application P201131146, filed Jul. 6, 2011, the contents of each of which are hereby incorporated by reference into this application.

TECHNICAL FIELD OF THE INVENTION

The present invention relates to a method for forming a tubular container having two cavities for food products and to the container obtained through said method; where such method for forming is comprised in the field of food preservation, and it more specifically is aimed at food complements of beverages, soups, creams, ice-creams and infusions.

The purpose of this method for forming is to obtain a tubular container with two or more cavities for internally housing different food products (solids, powder, liquids . . . ), although it could contemplate housing non-food products such as medicinal products or small-sized products; where the container object of the invention is manufactured quickly and simply, in addition to obtaining a compact and visually attractive arrangement, using fewer raw materials and with the possibility of completely automating both the forming of the container and the housing of the food products contained therein.

This method envisages obtaining a tubular container with two or more cavities, wherein the inner cavity is a hollow tubular element with free ends that is used as a suction element with respect to the product contained inside the outer cavity.

BACKGROUND OF THE INVENTION

By way of introduction, different sweetening and edible stirring utensils are known, which utensils raise various manufacturing problems, for example in relation to manufacturing processes, there is a known need for carrying out different processes such as:

- Waterproofing and separating coatings between cookie and sweetener to thus prevent residues in the contact area between the two elements;
- drying the coating;
- process for fixing the sweetener in the cookie;
- sealing the holding; and
- final drying.

Where in addition to the drawbacks in relation to the manufacturing process, there is the drawback of a possible detachment of the sugar or sweetener during the process of transporting said utensil to the point of consumption.

Hence the need for a container capable of housing both the described utensil and different similar food products separated therein; to that end containers having a single cavity for housing the food product are known, but when introducing not only sugar, for example, but also additional products such as cookies or sweeteners, it is necessary to use containers having two or more cavities.

Such containers having two cavities are formed by means of joining two single containers by joining separate sheets; then it involves independently making and forming two single containers to subsequently join them together forming a single container formed by the two cavities of each of the containers.

Containers made of a rigid material are also known, but these do not allow forming the container and filling it in a single method, i.e., a first manufacturing method and a second filling method for filling each cavity of the container are needed, in addition to additional drawbacks related to closing the ends and subsequently opening them.

Therefore, in view of the drawbacks mentioned above, a new container and a method for forming it that allows having two or more cavities for internally housing different food products is needed, the forming process of which is simple and consists of few steps, using little raw material and additionally obtaining a distinguishing design that is attractive to users.

DESCRIPTION OF THE INVENTION

The present invention relates to a method for forming a tubular container conceived for containing and dispensing products, preferably food products, in a simple manner and with a compact and attractive arrangement, and to the resulting container; where it comprises the following steps performed on a flexible sheet, preferably a heat-sealable plastic sheet, though not disregarding different options such as aluminum, cellulose, mixtures used for flow pack containers, paper, biodegradable material for containers, organic and therefore biodegradable packaging material, etc., with or without a sealable or heat-sealable coating, etc.:

a) folding or rolling a portion of said flexible sheet forming a first tubular body;

b) sealing one of the bases of the first tubular body such that part of the two inner faces thereof are joined together;

c) folding or rolling the rest of the flexible sheet which is not part of said first tubular body concentrically or non-concentrically around the first tubular body, forming a second tubular body outside the first tubular body, i.e., a first tubular body is made with the flexible sheet itself, and a second tubular body sized similarly to the first tubular body and located outside the latter is formed with the rest of the flexible sheet; and d) joining part of the final longitudinal end, which is wider or narrower, of the inner surface of the second tubular body to part of the outer surface of the first tubular body or joining it to the surface forming the tubular body, forming two independent cavities:
   - a first cavity inside the first tubular body; and
   - a second cavity inside the second tubular body and outside the first tubular body.

It is observed that in step b), when sealing one of the bases of the first tubular body a cavity is formed inside said tubular body, and in step d), when joining part of the final longitudinal end of the inner surface of the second tubular body to part of the outer surface of the first tubular body, the two cavities (first and second) are independent from one another and can house completely different food products or one of these cavities could be empty and being a hollow tubular body which will be used as a suction body with respect to the product contained in the outer cavity. In other words, the second cavity is formed by the space between the outer surface part of the first tubular body in its area for sealing the base thereof, with the inner surface part of the second tubular body created in the second rolling; such that the second cavity is formed as it is completed with the wall of the second rolling.

The resulting container is a container formed by a double concentric rolling of a flexible sheet material, and this double concentric rolling achieves a superposition of layers, and therefore a two-layer tubular body, created from a single sheet of material (the container is created by a single piece or sheet of material).

A variant of the method envisages making a container as follows:

a) folding or rolling a portion of said flexible sheet forming a first tubular body;

b) trimming the length of this body with respect to the rest of the remaining flexible sheet, c) folding or rolling the rest of the flexible sheet which is not part of said first tubular body concentrically or non-concentrically around the first tubular body, forming a second tubular body outside the first tubular body; i.e., a first tubular body is made with the flexible sheet itself, and a second tubular body sized similarly to the first tubular body and located outside the latter is formed with the rest of the flexible sheet; and d) joining part of the final longitudinal end, which is wider or narrower, of the inner surface of the second tubular body to part of the outer surface of the first tubular body or joining it to the surface forming the tubular body, forming two independent cavities:

- a first cavity inside the first tubular body forming a hollow tube open at both ends which becomes a suction element with respect to the product contained in a second cavity; and
- a second cavity inside the second tubular body and outside the first tubular body which is filled with a product.

In step d), the possibility of joining part of the final longitudinal end, which is wider or narrower, of the inner surface of the second tubular body to part of the outer surface of the first tubular body such that the first cavity has a single access to the outside through one of the sides of the formed container and the second cavity has a single access to the outside through the other one of the sides of the formed container, is contemplated; i.e., accesses to the two cavities are independent and each of them is located at each end of the container, so if one of the ends is opened, only the food product inside one cavity could be accessed, the other cavity being isolated; and where to access the product inside that second cavity it is necessary to open the other end of the container, i.e., a single product can be dispensed and metered out without needing to dispense both products at the same time by opening the container.

With respect to the steps described above, the possibility of performing step c) before step b) is contemplated; i.e., first the rest of the flexible sheet which is not part of said first tubular body is rolled or folded concentrically around the first tubular body, forming the second tubular body outside the first tubular body, to subsequently seal one of the bases of the first tubular body.

Certain steps can also be performed simultaneously, saving in manufacturing times and, therefore, in the overall finished product cost.

Once the first and second cavity are made and formed, the possibility of the method comprising the following steps after step d) is contemplated:

e) Introducing a first food product inside the first cavity or alternatively leaving it empty;

f) sealing at least one of the bases belonging to the first cavity, resulting in the first cavity being completely closed and with the first product housed therein or simply being empty;

g) introducing a second food product inside the second cavity; and h) sealing the unclosed base of the second cavity, resulting in the second cavity being completely sealed and with the second product housed therein.

Again, the order of introducing the foods and sealing of the cavities can vary in the described method for forming, provided that all the described technical steps are complied with.

And similarly to the previous steps, these new steps can be performed simultaneously, also saving in manufacturing times and, therefore, in the overall finished product cost.

And in relation to the type of food product ho be introduced, the following is contemplated:

in step e), the first product comprises a solid food product, such as a cookie or candy bar, for example; and in step g), the second product comprises a powder food product, for example sugar, sweetener, flavoring, functional products, vitamins, products that can create beverages such as tea, coffee, cocoa, juice, broth, milk, brandy, or a mixture thereof.

Again, it is understood that the products introduced in the cavities can be products in solid state, powder state, liquid state . . . , and that they can be introduced indistinctly in one cavity or the other. When introducing a liquid product, the welds or the sealing of the cavities must be correctly assured during said method.

The possibility of heat-sealing the two superimposed layers forming the double rolling to one another in the entire area of the first cavity, or heat-sealing only a perimetral bead arranged parallel to the base of the tubular body or diagonally, at the point where the two cavities coincide approximately is contemplated, although the suitable pressure of the double rolling and the final sealing may be enough for proper waterproofing of the respective cavities.

Within the present invention which, as described, relates to a method for forming a tubular container for food products and to the resulting tubular container, a second possibility relating to the method for obtaining said container is contemplated, where this second possibility is complementary to the preceding possibility, and achieves part of the technical effects derived from the first possibility, but where the mode of forming thereof is simpler even though the advantage of being able to open a side of the container and accessing a single cavity is not achieved because this second possibility comprises the following steps also performed on a flexible sheet:

a) folding or rolling a portion of said flexible sheet forming a first tubular body, so the first step is common for the two possibilities for forming the container.

b) folding or rolling the rest of the flexible sheet which is not part of said first tubular body concentrically or non-concentrically around the first tubular body, forming a second tubular body outside the first tubular body. It is observed that the rolling or folding is not concentric, so it is impossible for the outer surface of the first tubular body to come into contact with the inner surface of the second tubular body in its entirety, and at all times there are two spaces that are physically separated from one another but their ends are open in both bases of the container to be formed, where, for the sake of clarification, when observing the cross section formed in the container, it is observed that the first cavity defined by the first tubular body comprises a tubular section, and the second cavity defined by the second tubular body comprises a tubular section with a crescent-shaped geometry (if the tubular bodies are circular).

c) joining part of the final longitudinal end, which is wider or narrower, of the inner surface of the second tubular body to part of the outer surface of the first tubular body, forming two independent cavities:
   a first cavity inside the first tubular body; and
   a second cavity inside the second tubular body and outside the first tubular body.

It can be observed that in this second possibility it is not necessary to seal one of the bases of the first tubular body to define the two cavities, therefore the method is simplified in said step, but it has the small drawback that once the respective bases of the formed container are sealed and the products are located therein, both products are physically separated from one another, when the user opens one of the bases of the formed container, the user himself/herself therefore has access to respective cavities of said container, and can therefore access the respective products; such feature is not found in the first possibility of the method for forming the container object of the invention, because in said first possibility, when the user opens one of the bases of the formed container, he/she accesses a single cavity without the possibility of accessing the product housed in the other cavity.

The following steps are also contemplated in this second possibility:

e) introducing a first food product inside the first cavity or leaving it empty;
f) sealing at least one of the bases belonging to the first cavity, resulting in the first cavity being closed in at least one of its ends and with the first product housed therein or simply being empty;
g) introducing a second food product inside the second cavity; and
h) sealing the bases of the second cavity, resulting in the second cavity being completely sealed and with the second product housed therein.

Therefore, according to the described invention, the container and method for forming it are an important novelty in methods for forming containers and the visual appearance of such containers because it allows having two or more cavities for internally housing different food products, where the forming process is simple and consists of a small number of steps, using little raw material and additionally obtaining a distinguishing design that is attractive to users, being able to be formed and filled in the same method object of the invention.

DESCRIPTION OF THE DRAWINGS

To complement the description being made and for the purpose of aiding to better understand the features of the invention, according to a preferred practical embodiment thereof, a set of drawings is attached as an integral part of said description where the following has been depicted with an illustrative and non-limiting character.

PREFERRED EMBODIMENT OF THE INVENTION

Figure 1:
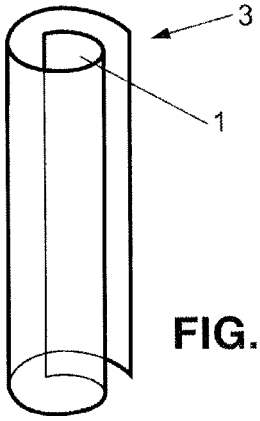
FIG. 1 shows a schematic view of the flexible sheet used for forming the entire container object of the invention.
Figure 2:
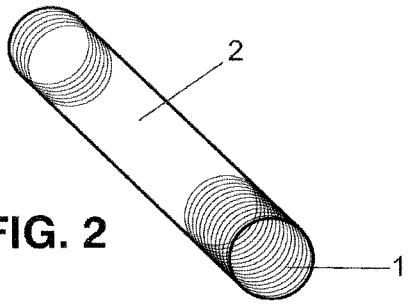
FIG. 2 shows the flexible sheet that is folded or rolled into two tubular sections, one on top of the other, like a two-layer tubular container.
Figures 3A, 3B:
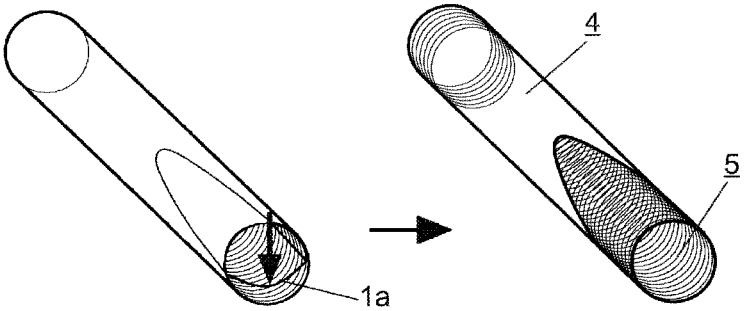
FIGS. 3A and 3B show the step of sealing one of the bases of the first tubular body, both first and second cavities suitable for housing the respective food products being formed.
Figure 4A:
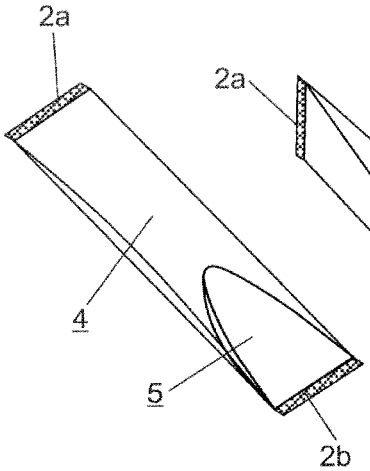
FIGS. 4A, 4B and 4C show different embodiments of sealing both bases of the container obtained by the first method object of the invention described above.
Figure 4B:
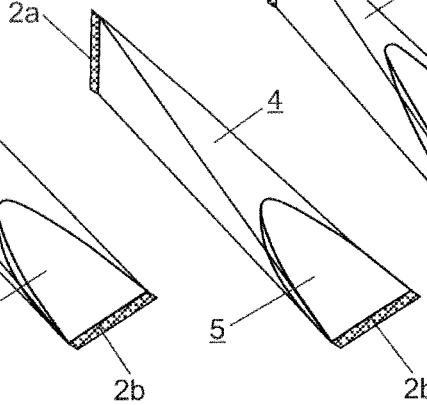
Figure 4C:
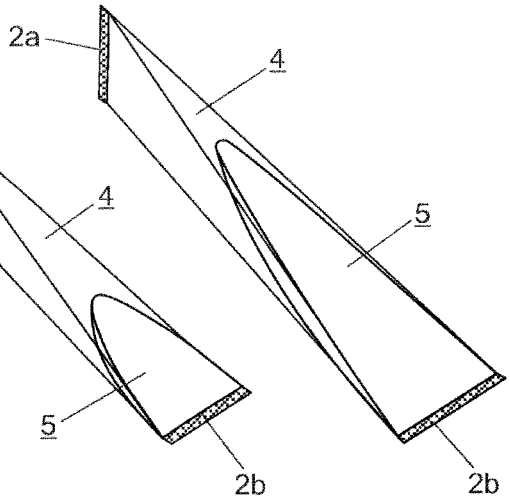
Figure 5:
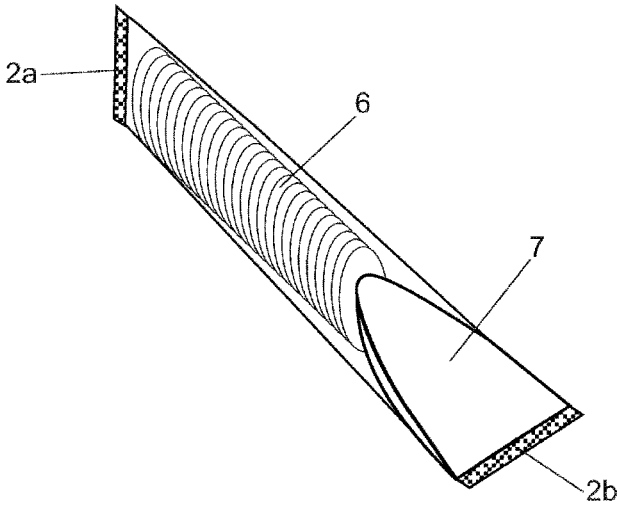
FIG. 5 shows a schematic view of a container formed with the first method object of the invention, and where two food products are observed inside respective inner cavities of the formed container.

As can be observed in the sequence of FIGS. 1 to 5, the method for forming this container for food products comprises performing the following steps on a flexible sheet (3), where the steps are:

a) rolling a portion of said flexible sheet (3), forming a first tubular body (1), as can be observed in FIG. 1;
b) sealing one of the bases (1*a*) of the first tubular body (1), the sequence of folding and sealing said base (1*a*) of the first tubular body (1*a*) being observed in the sequence of FIGS. 3A and 3B;
c) rolling the rest of the flexible sheet (3) which is not part of said first tubular body (1) concentrically around the first tubular body (1), forming a second tubular body (2) outside the first tubular body (1), as can be observed in FIG. 2;
d) joining part of the final longitudinal end, which is wider or narrower, of the inner surface of the second tubular body (2) to part of the outer surface of the first tubular body (1), forming two independent cavities:
   a first cavity (4) inside the first tubular body (1); and
   a second cavity (5) inside the second tubular body (2) and outside the first tubular body (1), as shown in FIGS. 4A, 4B and 4C.
e) introducing a first food product (6) inside the first cavity (4);
f) sealing the base (2*a*) belonging to the first cavity (4), resulting in the first cavity (4) being completely closed and with the first product (6) housed therein;
g) introducing a second food product (7) inside the second cavity (5), as can be observed in FIG. 5; and
h) sealing the unclosed base (2*b*) belonging to the second cavity (5), resulting in the second cavity (5) being completely sealed and with the second product (7) housed therein.

It can be seen that it is possible to carry out different closures in the container thus formed, both closures being able to be parallel (see FIG. 4A) or perpendicular (see FIG. 4B) to one another, or being able to be another type of closure that adapts to the shape of the inner product, or tie-type closure, etc.; and in view of FIGS. 4B and 4C the volumes of the cavities (4, 5) where respective products (6, 7) are introduced can also be modified.

Figure 6:
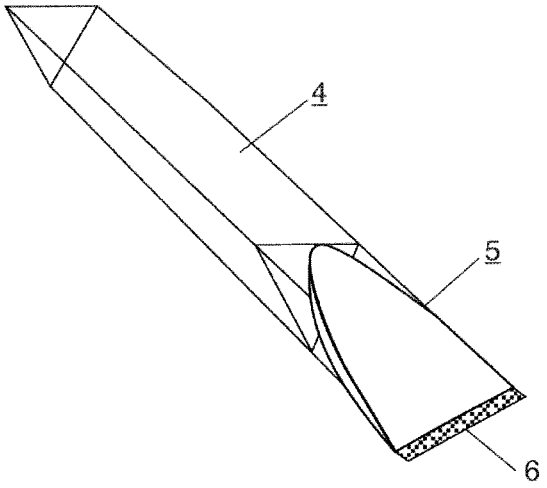
FIG. 6 shows a schematic view of another container formed with the first method object of the invention, but where the tubular section is a prismatic section.

It is also observed in FIG. 6 that the geometric formation of the container does not necessarily have to be a tubular container having a circular section, but rather different geometries are contemplated such as a tubular body having a square section, a prismatic body having a triangular section, as shown in FIG. 6, or similar embodiments. The possibility of combining concentric rollings of different tubular section, or for example combining a first cylindrical rolling with a second conical rolling (likewise being two concentric tubular rollings), etc., is also contemplated.

Figure 7:
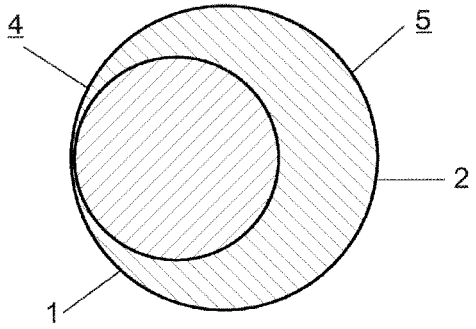
FIG. 7 shows an elevational view of the container formed according to the second method object of the invention, where the first and second tubular bodies are not concentric.

Finally and in relation to a second embodiment possibility of a method for forming a tubular container for food products, it is observed in FIG. 7 that said second method comprises performing the following steps on a flexible sheet (3):

a) rolling a portion of said flexible sheet (3) forming a first tubular body (1);

b) rolling the rest of the flexible sheet (3) which is not part of said first tubular body (1) non-concentrically around the first tubular body (1), forming a second tubular body (2) outside the first tubular body (1); and c) joining part of the final longitudinal end, which is wider or narrower, of the inner surface of the second tubular body (2) to part of the outer surface of the first tubular body (1), again forming two independent cavities:

a first cavity (4) inside the first tubular body (1); and a second cavity (5) inside the second tubular body (2) and outside the first tubular body (1).

Respective cavities (4, 5) have access to the outside through respective bases or ends of the container thus formed.

Figure 8:
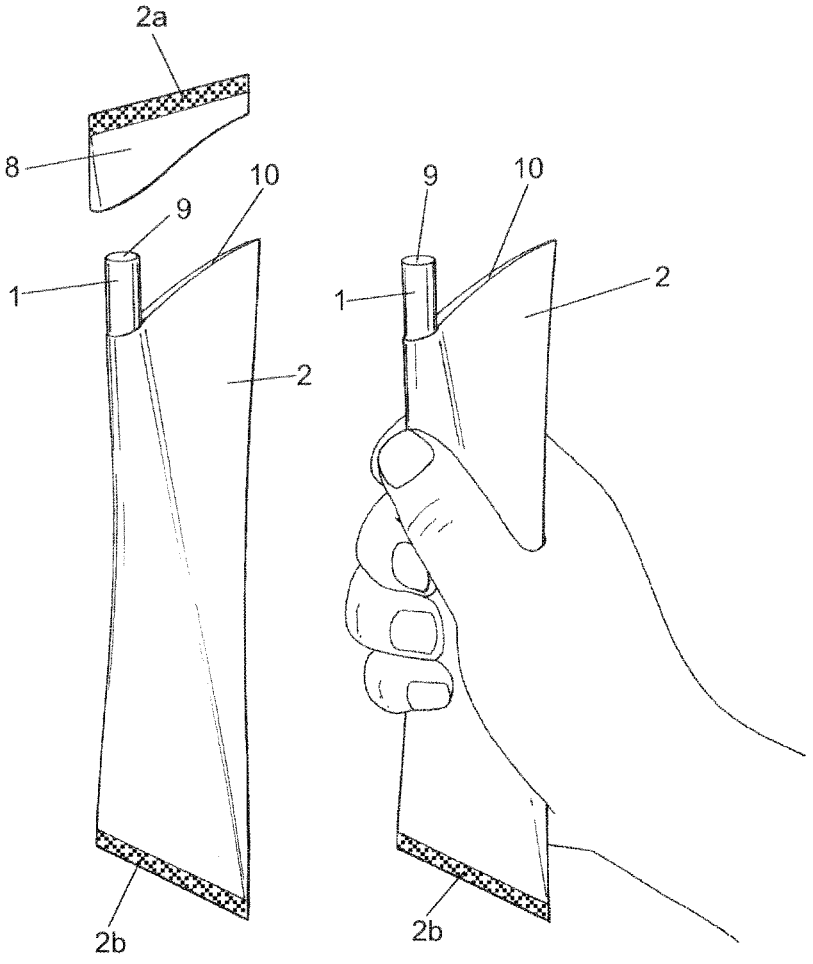
FIG. 8 shows two depictions of a container variant in which the first inner tubular body is a suction element with respect to the product incorporated inside the second tubular body.

FIG. 8 shows two depictions of a container variant in which the first inner tubular body is a suction element with respect to the product incorporated inside the second tubular body A variant of the method envisages making a container as follows:

a) folding or rolling a portion of said flexible she forming a first tubular body (1);

b) trimming the length of this body with respect to the rest of the remaining flexible sheet, c) folding or rolling the rest of the flexible sheet which is not part of said first tubular body concentrically or non-concentrically around the first tubular body, forming a second tubular body (2) outside the first tubular body; i.e., a first tubular body is made with the flexible sheet itself, and a second tubular body sized similarly to the first tubular body and located outside the latter is formed with the rest of the flexible sheet; and d) joining part of the final longitudinal end, which is wider or narrower, of the inner surface of the second tubular body to part of the outer surface of the first tubular body or joining it to the surface forming the tubular body, forming two independent cavities:

a first cavity (9) inside the first tubular body (1) forming a hollow tube open at both ends which becomes a suction element with respect to the product contained in a second cavity (10); and a second cavity (10) inside the second tubular body (2) and outside the first tubular body, which is filled with a product, Said FIG. 8 shows how the ends (2*a*) and (2*b*) close the second tubular body (2) without affecting the ends of the first tubular body (1), which is open at both ends and becomes a suction body with respect to the product contained inside the second tubular body. A first end (8) of the second tubular body (2) is detachable, as shown in the figure on the left, exposing the end of the first tubular body (1) which is a suction element with respect to the product contained inside the second tubular body (2). An extremely hygienic container for consuming products is made with this solution because the suction element is always concealed by the container itself.

In view of this description and set of drawings, the person skilled in the art will understand that the embodiments of the invention that have been described can be combined in many ways within the object of the invention. The invention has been described according to some preferred embodiments thereof, but it will be evident for the person skilled in the art that many variations can be introduced in said preferred embodiments without exceeding the object of the claimed invention.

The invention claimed is:

1. A method for forming a tubular container for food products, wherein the tubular container is formed and filled in the same method, characterized in that it comprises the following steps performed from a single piece of a flexible sheet (3) material:

a) folding or rolling, in a first rolling step, a portion of said flexible sheet (3) forming a first tubular body (1);

b) sealing one of the bases (1*a*) of the first tubular body (1) to close off an end of the first tubular body (1);

c) folding or rolling, in a second rolling step performed after the sealing step of closing said end of the first tubular body (1) in b) and distinct from the first rolling step, the rest of the flexible sheet (3) which is not part of said first tubular body (1) concentrically around the first tubular body (1), forming a second tubular body (2) outside the first tubular body (1); and d) joining part of a final longitudinal end of the inner surface of the second tubular body (2) to part of the outer surface of the first tubular body (1), forming two independent cavities:

a first cavity (4) inside the first tubular body (1); and a second cavity (5) inside the second tubular body (2) and outside the first tubular body (1), said second cavity (5) being a space formed between the outer surface of the first tubular body (1) in an area for sealing a base thereof, and the inner surface of the second tubular body (2) formed in the second rolling step;

e) introducing a first food product (6) inside the first cavity (4);

f) sealing a base (2*a*) belonging to the first cavity (4), resulting in the first cavity (4) being completely closed and with the first product (6) housed therein;

g) introducing a second food product (7) inside the second cavity (5); and h) sealing an unclosed base (2*b*) belonging to the second cavity (5), resulting in the second cavity (5) being completely sealed and with the second product (7) housed therein.

2. The method for forming a tubular container for food products according to claim 1, characterized in that in step d), joining part of the final longitudinal end of the inner surface of the second tubular body (2) to part of the outer surface of the first tubular body (1) is performed such that the first cavity (4) has a single access to the outside through one of the sides of the formed container; and the second cavity (5) has a single access to the outside through the other one of the sides of the formed container.

3. The method for forming a tubular container for food products according to claim 1, characterized in that step c) is performed before step b).

4. The method for forming a tubular container for food products according to claim 1, characterized in that in step e), the first product (6) comprises a solid food product; and in step g), the second product (7) comprises a powder food product.

5. A tubular container for food products obtained according to the method defined in claim 1.

6. A method for forming a tubular container for food products, wherein the tubular container is formed and filled in the same method, characterized in that it comprises the following steps performed from a single piece of a flexible sheet (3) material:

a) folding or rolling, in a first rolling step, a portion of said flexible sheet (3) forming a first tubular body (1), and sealing (or fixing) said formed first tubular body to the inner face of the flexible sheet (3);

b) folding or rolling, in a second rolling step performed after the sealing step in a) and distinct from the first rolling step, the rest of the flexible sheet (3) which is not part of said first tubular body (1) concentrically or non-concentrically around the first tubular body (1), forming a second tubular body (2) outside the first tubular body (1);

c) joining part of a final longitudinal end of the inner surface of the second tubular body (2) to part of the outer surface of the first tubular body (1) or joining it to the surface forming the second tubular body (2), forming two independent cavities:

a first cavity (4) inside the first tubular body (1); and a second cavity (5) inside the second tubular body (2) and outside the first tubular body (1), said second cavity (5) being a space formed between the outer surface of the first tubular body (1) in an area for sealing a base thereof, and the inner surface of the second tubular body (2) formed in the second rolling step;

d) introducing a first food product (6) inside the first cavity (4) or alternatively leaving it empty;

e) introducing a second food product (7) inside the second cavity (5); and f) sealing an unclosed base of the second cavity (5), resulting in the second cavity (5) being completely sealed and with the second food product (7) housed therein, whereby, the first tubular body (1) is open at both ends forming a suction element with respect to the product contained in the second tubular body (2), wherein the ends (2*a*, 2*b*) of the second tubular body (2) close said second tubular body (2) without affecting the ends of the first tubular body (1), which is open at both ends and becomes a suction body with respect to the product contained inside the second tubular body (2).

7. The method for forming a tubular container for food products according to claim 6, characterized in that between steps d) and e) there is a step consisting of g) sealing at least a base of the first cavity (4), resulting in the first cavity (4) being closed in at least one of its ends.

8. The method for forming a tubular container for food products according to claim 6, characterized in that after step a) the method comprises an additional step of trimming the length of the first tubular body (1) with respect to the rest of the remaining flexible sheet (3).

9. The method for forming a tubular container for food products according to claim 6, characterized in that a first end (8) of the second tubular body (2) is detachable, exposing the end of the first tubular body (1) which is a suction element with respect to the product contained inside the second tubular body (2).

* * * * *